US005628213A

United States Patent [19]

Broadbent

[11] Patent Number: 5,628,213

[45] Date of Patent: May 13, 1997

[54] VHS VIDEOCASSETTE SECURITY DEVICE

[76] Inventor: James M. Broadbent, 14 Westwood Dr., Wilbraham, Mass. 01095

[21] Appl. No.: 422,896

[22] Filed: Apr. 17, 1995

[51] Int. Cl.[6] ..... E05B 73/00

[52] U.S. Cl. ..... 70/58; 70/57; 70/402; 70/345; 70/14

[58] Field of Search ..... 70/14, 57, 58, 70/409, 379 R, DIG. 8, 19, 370, 34, 367, 336, DIG. 2, DIG. 20, DIG. 69, DIG. 27, DIG. 52, 402, 403, 405, 406, 344, 345

[56] References Cited

U.S. PATENT DOCUMENTS

| | | | |
|---|---|---|---|
| 1,896,523 | 2/1933 | Main | 70/370 |
| 3,404,548 | 10/1968 | Keefer | 70/404 |
| 3,637,180 | 1/1972 | Parry | 70/403 |
| 4,362,036 | 12/1982 | Shanklin | 70/14 |
| 4,628,713 | 12/1986 | Cecchi et al. | 70/58 |
| 4,716,745 | 1/1988 | Hehn | 70/58 |
| 5,261,259 | 11/1993 | Ployd | 70/58 |
| 5,404,733 | 4/1995 | Fitzpatrick | 70/58 |

FOREIGN PATENT DOCUMENTS

| | | | |
|---|---|---|---|
| 1354883 | 5/1974 | United Kingdom | 70/238 |

*Primary Examiner*—Darnell M. Boucher
*Attorney, Agent, or Firm*—Scott B. Garrison; Gary E. Lambert

[57] ABSTRACT

A tamper resistant device designed to be fitted into the blind hole of a standard VHS videocassette tape in such a manner as to prevent use/loading of the cassette. The device consists of a cylindrical body, pawl, cross pin, spring and a key for removal of the device. This device provides much more security than the current state of the art. Contents of the videocassette can neither be damaged by recording over existing program(s) nor can they be viewed, as insertion of the cassette into a player/recorder is prevented by the device. Furthermore, the device is designed to be compatible with all existing sleeves or covers used for storage. The device can be easily engaged without use of the key. Also, the device cannot be removed until the pawl neutral position is maintained while the device is being removed. Both the pawl and key hole design serve as tamper resistant components. Until the pawl's neutral postion is achieved, either of two locking surfaces engage an under cut built into the videocassette. As the pawl is spring loaded upward attempts at tampering will be hampered as any lifting of a tampering implement will cause the pawl to return to its locked position. Pushing the pawl downward, beyond its preset limit for release engages the double lock surface of the pawl. The key hole large diameter allows for sturdy key construction while the smaller diameter is designed to prevent tampering with the use of ordinary household items. It is the intent of this invention to provide an efficient and low cost means of providing security from loss or unauthorized viewing of videocassette tape contents.

4 Claims, 6 Drawing Sheets

VHS VIDEOCASSETTE SECURITY DEVICE

BACKGROUND OF THE INVENTION

VHS Video has been the standard media for recording/viewing video for the past ten years. Inherent to the design of this videocassette is a means to prevent accidental erasure or damage due to recording over existing recorded material. This device is a plastic tab that upon removal, leaves a recess at the rear of the videocassette. When this tab is removed sensors indicate this condition and prevent use of the videocassette recorder (VCR) record mode. However, application of a piece of adhesive tape over the recess, where the tab was located allows normal use of the videocassette. Also, this means of protection does not secure the videocassette against unauthorized viewing of the video tapes contents.

Generally, most video cassettes have a blind hole for the purpose of locating the videocassette during playing/recording. Generally, this same blind hole has opposing radial openings and at about mid depth of the hole. Intersecting this hole at the bottom of the videocassette is a track to prevent improper loading of the videocassette. A mating post built into the video recorder/player must pass uninhibited through this track for proper loading of the videocassette.

It is the principle object of this invention to provide a tamper resistant device that is of simple and inexpensive construction for use with standard VHS videocassette designs, is simple to use, and which is highly effective to ensure the safety of the contents of a videocassette tape from both damage and unauthorized viewing.

The above and other objects and advantages of this invention will be more readily apparent from the following descriptions read in conjunction with the accompanying drawings in which:

FIG. 1 is a perspective view, with a cut away view, of a standard VHS videocassette into which is fitted a security device of the type embodying this invention.

FIG. 1*a* is an enlarged perspective view detailing the cut away view in FIG. 1.

FIG. 6A thru D are cross section elevational views of said device shown in a cross sectional view of the blind hole of a videocassette, in four operative positions of the pawl.

Figure 1A:
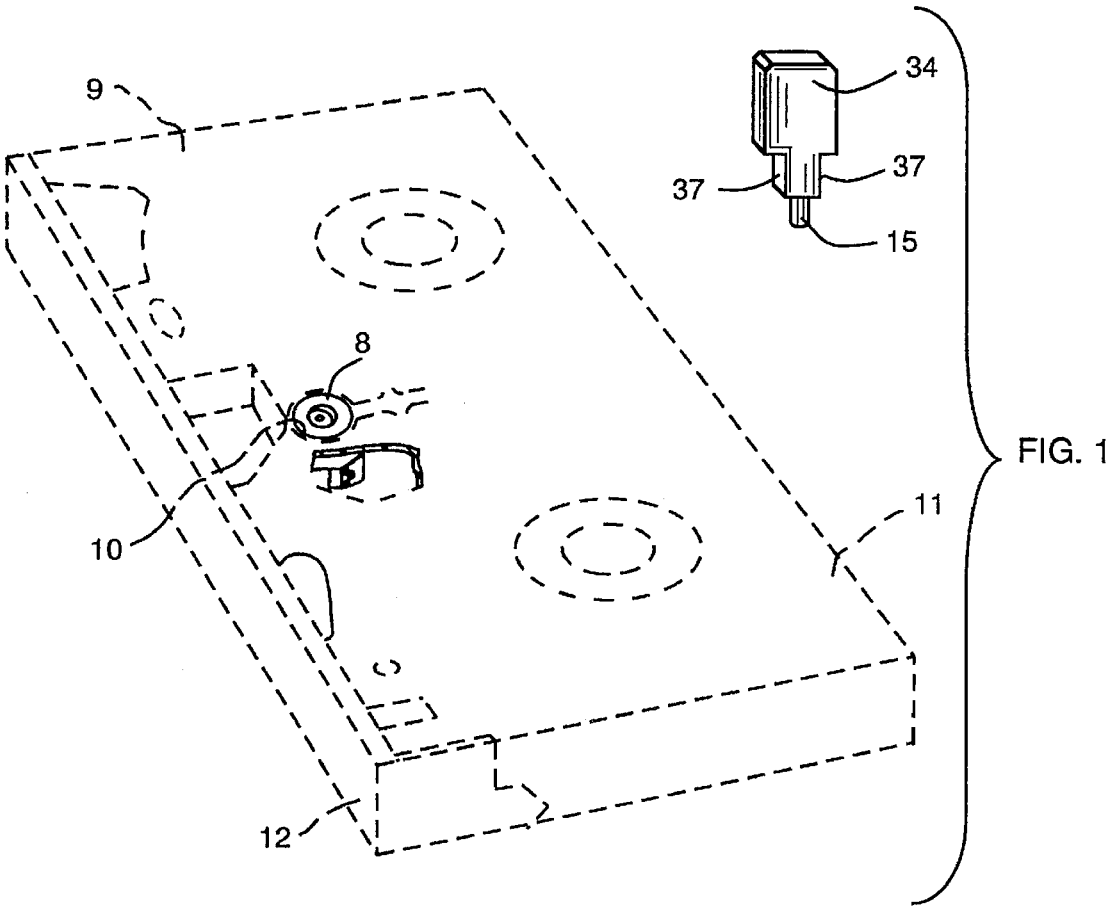
Figure 1A:
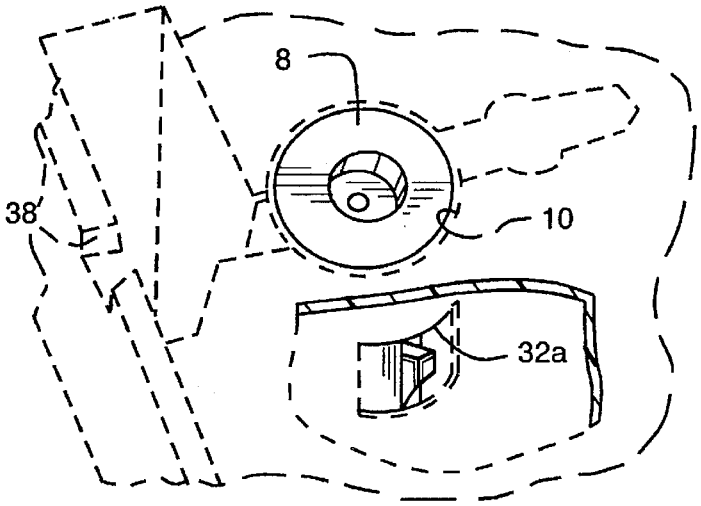
Figure 2:
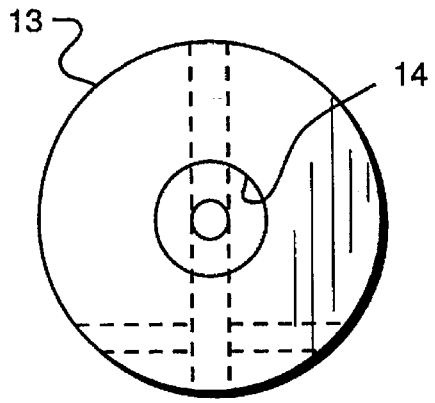
FIG. 2 is an elevational view of the body of said device.
Figure 3:
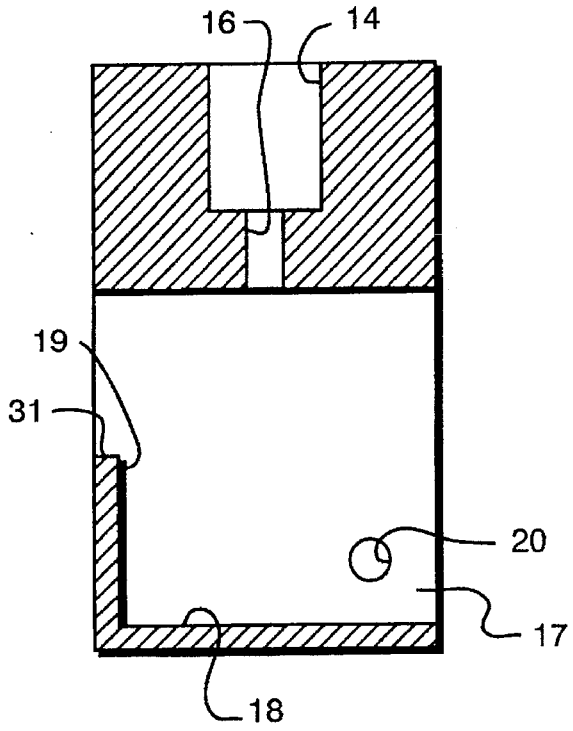
FIG. 3 is an elevational cross section view of the body of said device.

FIGS. 1 and 1*a* show a security device [8] which is fitted into the blind hole [10] of a conventional VHS videocassette tape [9], of the type being used extensively in commerce at the present time. As shown in FIGS. 2 and 3, the device consists of a cylindrical body [13] having an inside surface and an outside surface and further having a hole [14], said inside surface of said body further defining an opening [17] contiguous with said hole at the top for the fitting of a key. The circumference of said hole [14] is larger at the top than at the bottom of said hole. The larger hole serves to guide the working end of the key [15] into the smaller hole [16] and is also used during removal of the device [8]. Said inside surface defines a radial opening [17], forms a bottom wall [18] and extends radially through the center of said body forming a partial side wall [19] adjacent to the bottom wall and continues above the side wall through the opposite side of the body. A diameter [20] is bored through the body [13] perpendicular to its axis and perpendicular to the larger radial opening [17] for the fitting of a cross pin [22] (FIGS. 2–4).

Figure 4:
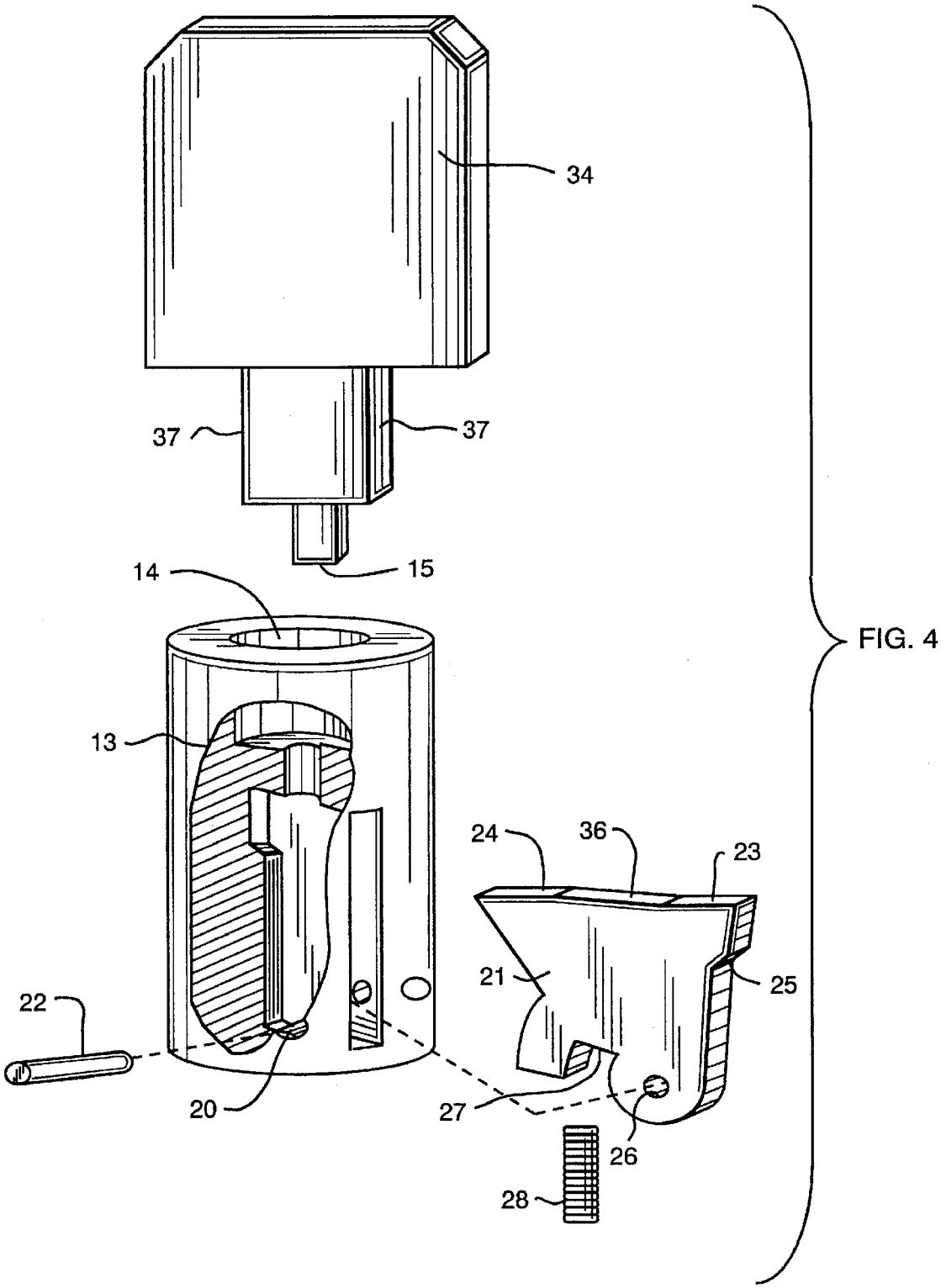
FIG. 4 is an exploded view of said device.
Figure 6:
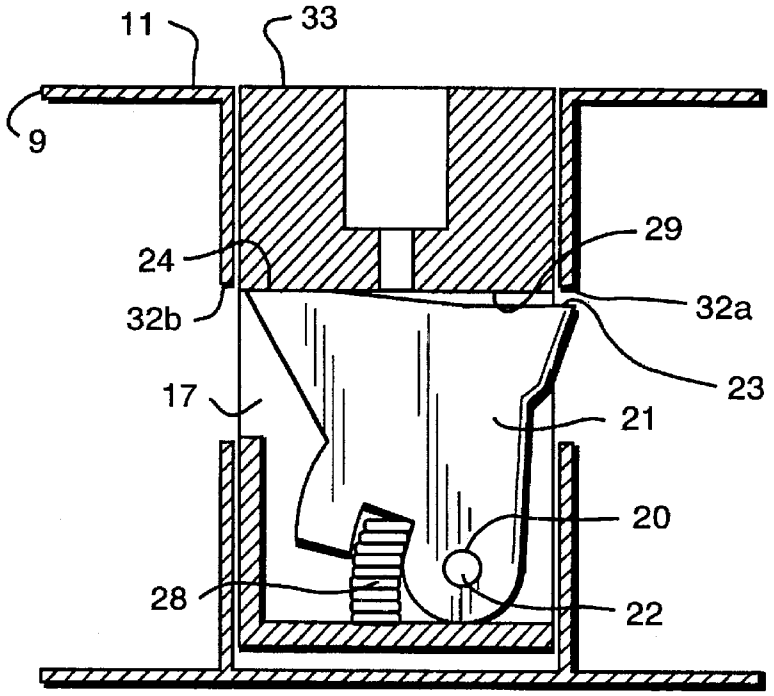
FIG. 6 is a cross section elevational view of the blind hole of a videocassette showing the radial undercuts and in which is shown an cross section elevational view of the assembly of said device in the locked position.
Figure 6B:
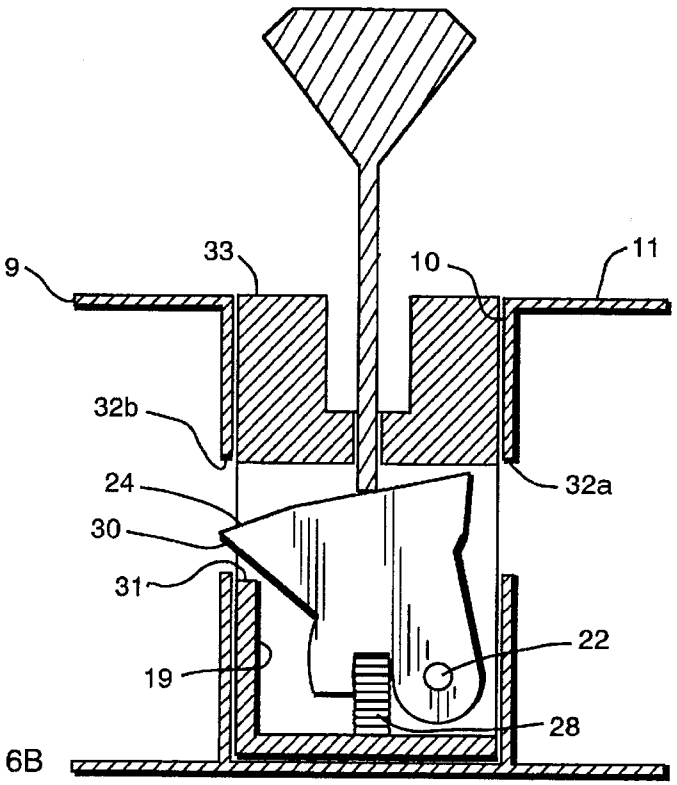

As depicted in FIG. 4, a pawl [21] is moveably disposed within the radial opening [17] and is moveably attached to the inside surface thru hole [26] by a cross pin [22]; such that, the primary locking surface [23] protrudes beyond the body [13] and a secondary locking surface [24] radially opposite the primary locking surface [23] is positioned inside the cylinder by an equal amount. The pawl is biased to a predetermined position by a spring [28] having two ends. The spring is contained at one end by a notch [27] in the body of the pawl and at the opposite end by the bottom wall [18] of said inside surface [17]. Referring to FIG. 6, the pawl position is set by the top of the inside surface [29] and the cross pin hole [20] location. Furthermore, the pawl [21] is allowed to rotate between its rest or primary lock position and the secondary lock position of the pawl where the under side[30] of the secondary locking surface [24] strikes the top surface [31] of the cylinder's side wall [19] (FIG. 6*b*).

Figure 6A:
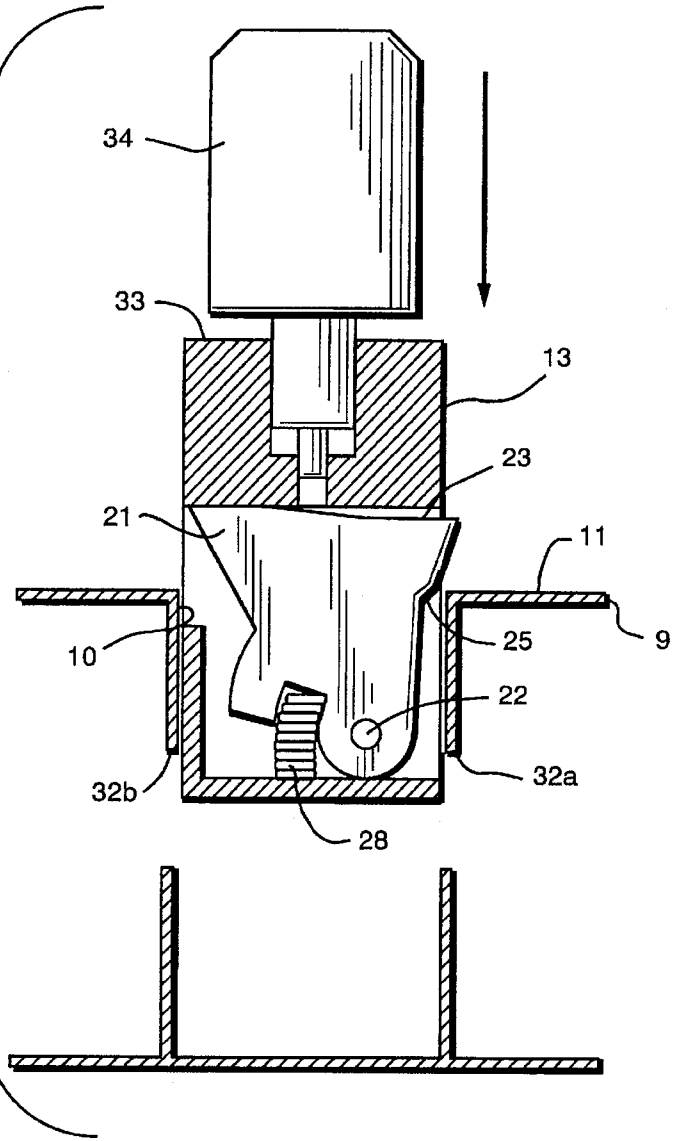
Figure 6D:
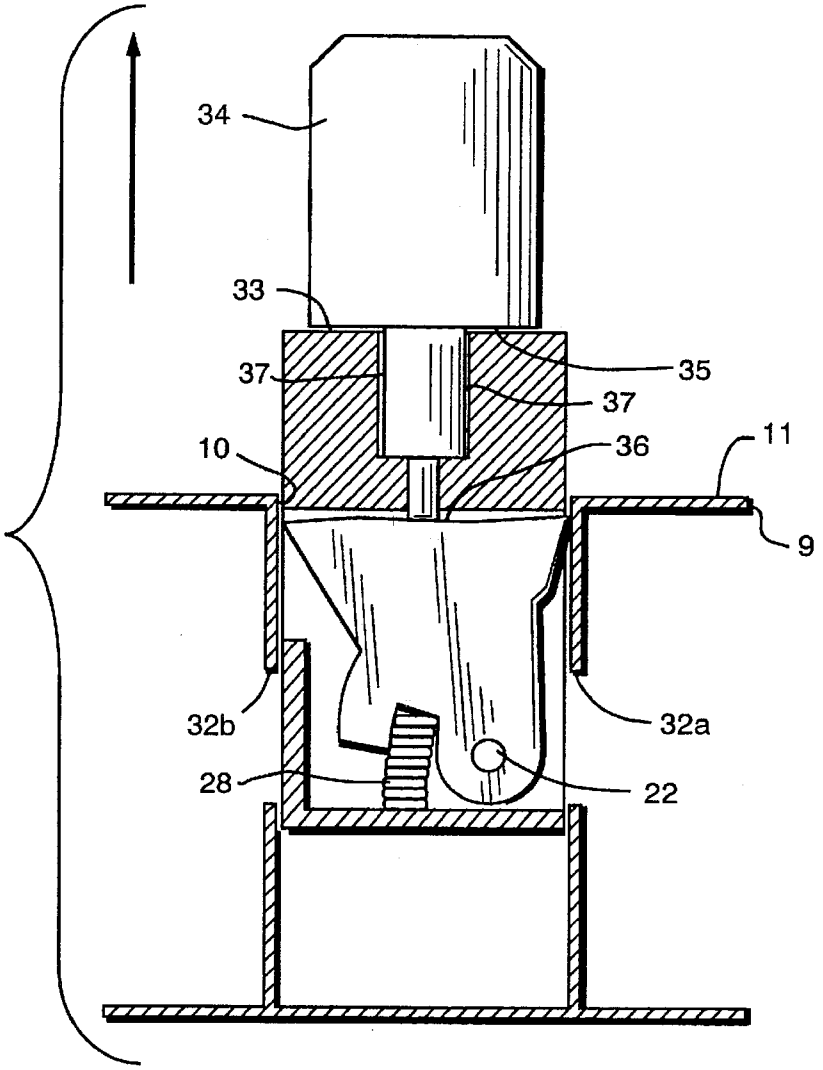

When the assembly is placed into the blind hole [10] of a standard videocassette, while maintaining the pawl [21] parallel to the length of the videocassette [9], the pawl [21] is rotated from its rest position by the caming action of pawl surface [25] against the wall of the blind hole[10] toward its neutral position (FIG. 6*a*). In this position, both primary locking surface [23] and secondary [24] locking surface are each substantially flush with the cylindrical body diameter [13] allowing full insertion of the device, without use of the key, into the blind hole [10].

Figure 5:
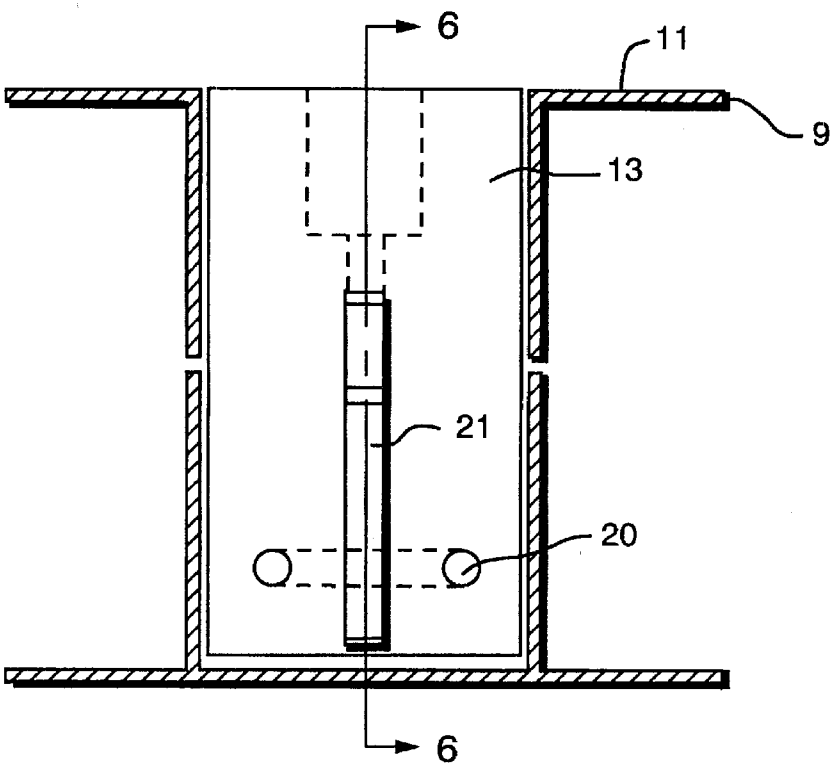
FIG. 5 is a cross section elevational view of the blind hole of a videocassette in which is shown an elevational view of said device in the locked position.

Prior to bottoming the device [8], the primary locking surface [23] engages in the radial undercut [32a] of the videocassette thus returning to its rest postion and thereby locking the device [8] in the videocassette [9] until the neutral position is achieved, allowing the device [8] to be extracted from the videocassette [9] (FIGS. 5 and 6). When fully bottomed the top surface [33] (having the larger circumference hole) of the device [8], is located flush with or slightly above the bottom surface of the videocassette [11] so as to substantially block the videocassette loading guide track [38] (used to prevent improper loading) located on the bottom surface [11], and adjacent to the front surface [12] of a standard VHS videocassette tape (FIG. 1). Thus loading of the videocassette [9] is prevented until the device [8] is removed.

Figure 6C:
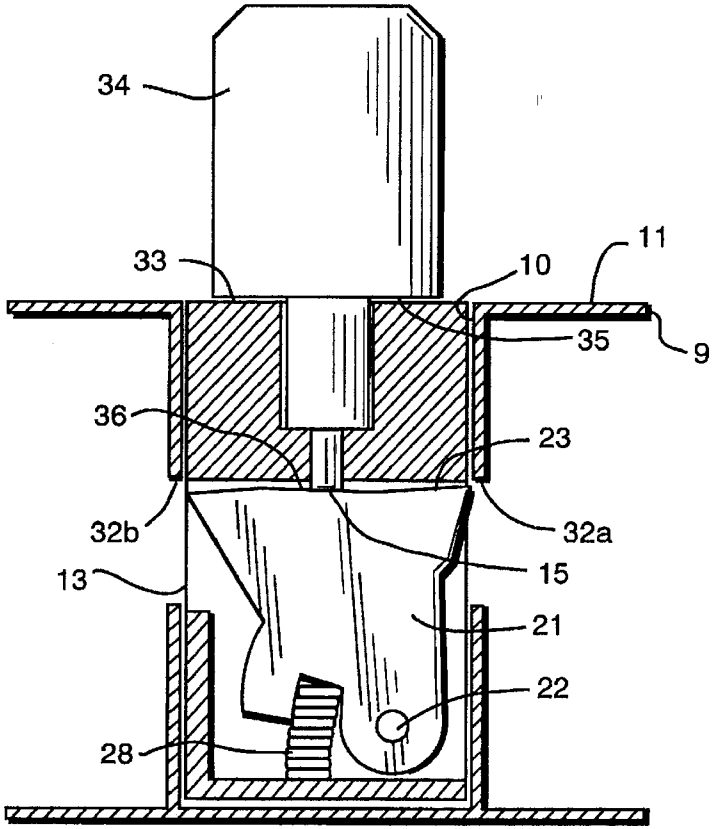

Furthermore, the secondary locking surface [24] provides a simple, inexpensive, and yet highly effective means of resisting tampering to accomplish removal of the device [8]. If the pawl [21] is depressed beyond the neutral position of the primary locking surface (FIG. 6*c*) in a direction opposite to that caused by the spring [28] force, the secondary lock surface [24] engages the videocassette undercut opposite the primary lock [23] causing the pawl [21] to interfere at the under cut surface [32b] thereby preventing removal of the device [8] (FIG. 6*b*). Removal can only be accomplished by insertion of a specially designed key. The key [34] is made of a compressible material and is designed to both set the pawl [21] in the neutral position and engage the larger circumference hole key hole [14] so as to maintain a frictional force allowing the device [8] to be extracted from the videocassette [9]. The pawl's [21] neutral position is achieved by bottoming the under side [35] of the key head against the top surface [33] of the body [13]. The pawl [21] is urged to rotate from its biased position under the force of the key tip [15] as the key contacts the pawl's top surface [36] (directly under the key tip [15]) as shown in FIG. 6*c*.

Once the neutral position of the pawl is achieved using the key, removal of the device [8] is accomplished by means of applying a force to the key [34] so as to lift the device [8] out of the blind hole [10]. Frictional loading between the sides of the key [37] bearing on the larger circumference hole [14] overcome the load of the spring [28] (FIG. 6*d*) thus allowing removal of said device. Due to the location of the device [8] in the videocassette, direction of bias of the spring, and the restrictive diameter of the small circumference hole; removal by any means other than the key [34] is substantially inhibited, as upward movement of any tampering device returns the pawl [21] to the primary lock postion.

Dimensions from the under side [35] of the key head to the key tip surface [15] and from the cross pin hole [20] to the pawl top surface,[36] achieve the predetermined neutral position. These dimensions are designed to be varied proportionally to provide unique key settings rather than a one key fits all condition.

A VHS videocassette locked in this manner is rendered unusable until the device is removed. The contents of the videocassette tape cannot be viewed or altered by conventional means as the videocassette cannot be loaded into a standard videocassette player/recorder. Thus the tape contents are secured from unauthorized use. This device significantly improves upon the present state of the art used to prevent accidental tape erasures. Additional security can provided by adapting a keyed lock to this system.

I claim:

1. A VHS tape security device comprising:

a cylindrical body having an inside surface and an outside surface and further having a hole wherein the circumference of said hole is greater at the top than at the bottom of said hole, said inside surface of said body further defining an opening contiguous with said hole wherein said opening extends radially through said body;

a pawl moveably disposed within said opening and moveably attached to the inside surface of said body by a cross pin, said pawl further having a notch and primary and secondary locking surfaces;

a spring having two ends wherein one end of said spring engages the inside surface of said body and the second end engages said notch whereby said spring causes said secondary locking surface to rest against said inside surface and further causes said primary locking surface to partially protrude outside of said cylindrical body.

2. A device as in claim 1 wherein said device fits into a blind hole of a VHS videocassette tape and locks into said device to prevent use/loading of said videocassette.

3. A device as in claim 1 further comprising a key having a top and bottom wherein the top of said key is larger than the bottom of said key and wherein said key is inserted into said hole so that the bottom of said key pushes against said pawl, moving said pawl against said spring and causing said primary and secondary locking surfaces to move inside and outside said body, and further allowing said pawl to lock in a predetermined postion.

4. A device as in claim 3 wherein friction between said key and the inside surface defining said hole overcomes the loading of said spring, thereby allowing removal of said device.

* * * * *